US005088938A

United States Patent [19]

Murakami et al.

[11] Patent Number: 5,088,938

[45] Date of Patent: Feb. 18, 1992

[54] TERMINAL LOCKING BLOCK FOR ELECTRICAL CONNECTORS

[75] Inventors: Yoshihiro Murakami; Takayuki Yammoto, both of Shizuoka, Japan

[73] Assignee: Yazaki Corporation, Tokyo, Japan

[21] Appl. No.: 522,002

[22] Filed: May 11, 1990

[30] Foreign Application Priority Data

May 29, 1989 [JP] Japan ..... 1-132796

[51] Int. Cl.[5] ..... H01R 13/422; H01R 13/436

[52] U.S. Cl. ..... 439/595

[58] Field of Search ..... 439/595, 744, 745

[56] References Cited

U.S. PATENT DOCUMENTS

| | | | |
|---|---|---|---|
| 4,565,416 | 1/1986 | Rudy et al. | 339/59 |
| 4,577,542 | 12/1985 | Coller et al. | 339/59 |
| 4,655,525 | 4/1987 | Hunt, III et al. | 339/63 |
| 4,714,437 | 12/1987 | Dyki | 439/595 |
| 4,787,864 | 11/1988 | Hunt, III et al. | 439/595 |
| 4,797,116 | 1/1989 | Isohata et al. | 439/595 |
| 4,806,123 | 2/1989 | Konishi et al. | 439/595 |
| 4,820,198 | 4/1989 | Lulko et al. | 439/595 |
| 4,826,452 | 5/1989 | Sian et al. | 439/595 |
| 4,900,271 | 2/1990 | Colleran et al. | 439/595 |
| 4,902,247 | 2/1990 | Suzuki et al. | 439/595 |
| 4,921,448 | 5/1990 | Endo et al. | 439/595 |
| 4,944,695 | 7/1990 | Tsuji et al. | 439/595 |
| 4,944,696 | 7/1990 | Sueyoshi et al. | 439/595 |
| 4,946,398 | 8/1990 | Takenouchi et al. | 439/595 |
| 4,975,082 | 12/1990 | Nagasaka et al. | 439/595 |

*Primary Examiner*—Gary F. Paumen
*Assistant Examiner*—Kevin J. Carroll
*Attorney, Agent, or Firm*—Armstrong, Nikaido, Marmelstein, Kobovcik & Murray

[57] ABSTRACT

A connector housing has terminal accommodating cavities therein and a first engagement projection in each of the cavities. A terminal locking block has a locking claw on a preliminary locking plate that loosely connects the block to the connector housing. The block also has second engagement projections on a flexible terminal locking plate. When the terminals are inserted into the cavities of the connector housing, the front end of the terminals abuts against the end of the flexible terminal locking plate and thereby pushes the block partly out of the housing. When the terminals are fully inserted, a space is formed in the cavities so that the block can be pushed into the housing until the second engagement projections snap into the engagement holes in the inserted terminals, thus locking the terminals and the block securely together. Since the block can be fully locked only when the terminals are fully inserted in the correct positions and because during the terminal insertion process the block is protruded partly out of the housing, any incomplete insertion of terminals can be checked and prevented.

2 Claims, 5 Drawing Sheets

TERMINAL LOCKING BLOCK FOR ELECTRICAL CONNECTORS

BACKGROUND OF THE INVENTION

The present invention relates to an electrical connector used for connecting wiring harnesses and more particularly to a terminal locking block which is mounted to a connector housing to prevent terminals inserted into cavities in the connector housing from slipping off backwards.

Prior Art

A common practice of locking terminals inserted in the terminal accommodating cavities in the connector housing involves forming a flexible locking arm integrally with the inner wall of each cavity so that the terminal inserted into the cavity is engaged with and locked by the locking arm and thereby is prevented from slipping off backwardly. In recent years, it has been proposed that a spacer be inserted into the connector housing from the front side to limit the deflection of the flexible arm in the opposite direction and thereby prevent dislocation of the terminal.

FIG. 4 shows a known structure for locking the terminals (Japanese Utility Model Preliminary Publication No. Showa 62-1382). The walls of terminal accommodating cavities a, a' in the female and male connector housings F, M are formed with engagement steps c, c' for engaging the terminals b, b'. On the wall facing the engagement steps are provided flexible arms e, e' which have deflection spaces d, d' of appropriate sizes formed therein. Spacers f, f' are inserted into the deflection spaces d, d' to securely lock the arms e, e' and terminals b, b' in position.

In the above conventional art, however, since the spacers f, f', as terminal locking members, are formed separate from the connector housings F, M and have no temporary retaining means, they cannot be preset in the housing and thus have to be removed and installed each time the terminals b, b' are inserted, increasing the number of steps required during connector assembly and control processes.

Even if two terminals b' are only partially inserted as shown in FIG. 5, the spacer f' can still be fitted. In addition, because the terminal accommodating cavities a' and terminals b' are small, it is difficult to check from outside the condition of the inserted terminals. Since the spacer is not integrated with but is formed separate from the connector housing, the possibility remains that an assembly worker may fail to correctly attach the spacers.

This invention has been accomplished to eliminate the above drawbacks and provide a terminal locking block which has a terminal locking member attached beforehand or preset in the connector housing and which has the function of checking for any incomplete insertion of terminals.

SUMMARY OF THE INVENTION

To achieve the above objective, the terminal locking block in an electrical connector according to this invention comprises: terminals adapted to be inserted from the rear of a connector housing, the terminals each having a base portion and an engagement hole in the base portion; a connector housing having terminal accommodating cavities, each of the cavities having a first engagement projection formed on one of the opposing wall surfaces of the cavity, the first engagement projection being adapted to engage the terminal fully inserted in a correct position; and a terminal locking block adapted to be mounted and locked to the front part of the connector housing in two steps, i.e., at a preliminary locked position and at a full locked position. The terminal locking block has a preliminary locking plate and a flexible terminal locking plate both of which extend rearwardly in the terminal accommodating cavities. The preliminary locking plate has locking means for the connector housing, and the flexible terminal locking plate has second engagement projections to engage the engagement holes of the terminals, whereby when the terminals are not inserted into the terminal accommodating cavities, the terminal locking block is attached to the connector housing by the locking means. When the terminals are inserted, the front end of the terminals abut the end of the flexible terminal locking plate to push the terminal locking block partly out of the terminal accommodating cavities. When the terminals are fully inserted to the correct position, a space is formed in the terminal accommodating cavities so as to allow the flexible terminal locking plate to advance therein. As the terminal locking block is pushed again into the terminal accommodating cavities, the second engagement projections of the flexible terminal locking plate engage the engagement holes of the terminals, thus fully locking the terminal locking block.

With the terminal locking block for connectors of this invention, when the terminals are not inserted, the preliminary locking plate is loosely attached to the connector housing (terminal accommodating cavities). This means that the terminal locking block can be preset to the housing, thus reducing the number of steps required during the connector assembly and control process. This also eliminates the problem of assembly workers forgetting to attach the terminal locking block.

During the process of terminal insertion, the terminal locking block, which is loosely attached to the connector housing, is pushed partly out of the housing and cannot be set in the locked position in the housing unless the terminals are fully inserted to the correct position. Therefore, any incomplete insertion of the terminals can be checked and prevented.

BRIEF DESCRIPTION OF THE DRAWINGS

FIGS. 3A through 3E are cross sections showing the relationship between the connector housing, the terminal locking block and the terminal; of which FIG. 3A illustrates the terminal at the start of the insertion process;

FIG. 3B illustrates the same in the middle of the insertion process;

FIG. 3C illustrates the same in the completely inserted condition;

FIG. 3D illustrates the terminal locking block in the fully locked condition; an FIG. 3E illustrates the terminal in a partially inserted condition.

DESCRIPTION OF THE PREFERRED EMBODIMENT

Figure 1:
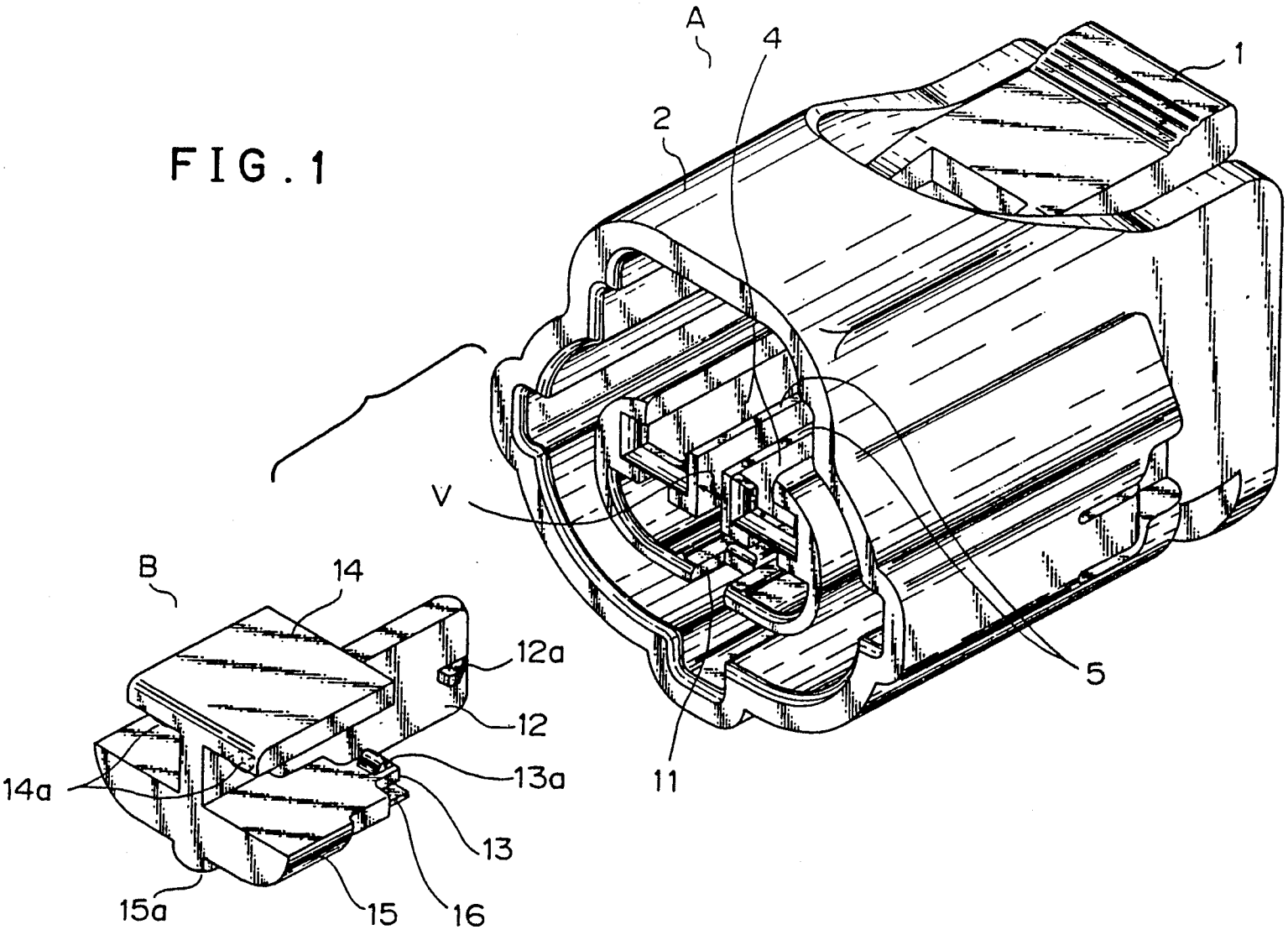
FIG. 1 is an exploded perspective view of a connector housing and a terminal locking block according to this invention.

Referring to FIG. 1, reference symbol a represents a male connector housing of synthetic resin, and B a terminal locking block of synthetic resin to be fitted to the front of the housing A. The male connector housing A is to be coupled with a counterpart female connector housing (not shown) and has on its outer periphery a locking arm 1 that engages the mating female connector housing, and a water-proofing hood 2. A water-proofing packing 3 (see FIG. 2) is fitted in a depth of a gap between the locking arm 1 and an inner wall 6.

Provided in the connector housing A are a pair of laterally arranged terminal accommodating cavities 4 separated by opposing side walls 5, between which a gap V is provided.

Figure 2:
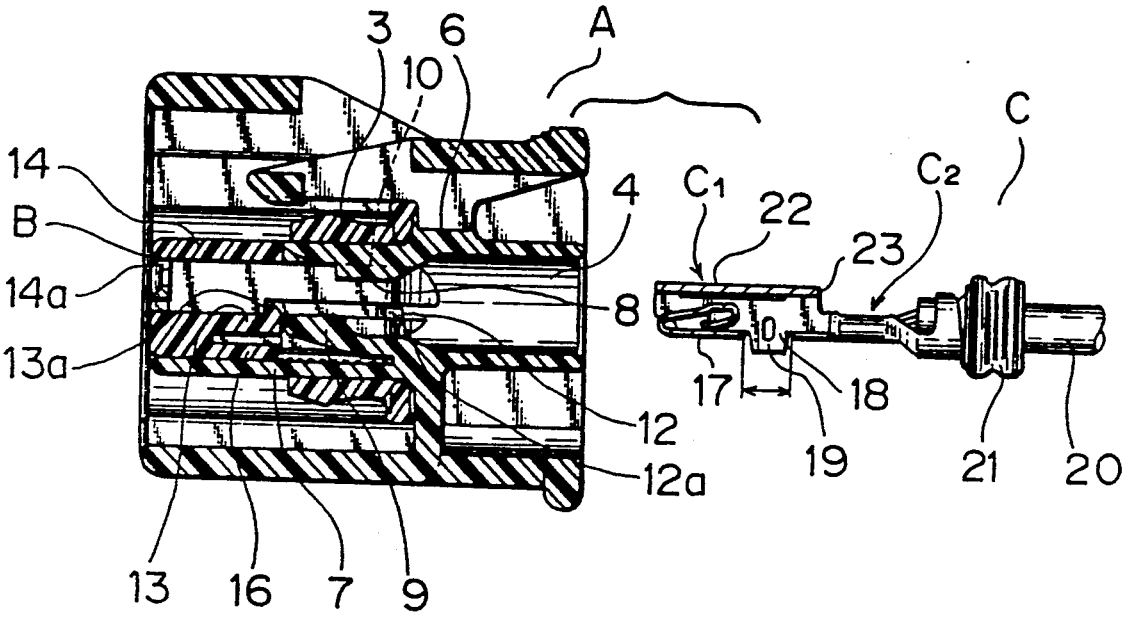
FIG. 2 is a cross-sectional side view showing the connector housing and the terminal locking block of FIG. 1 in a preliminary locked condition.

The terminal accommodating cavity 4 has, as shown in FIG. 2, opposing top and bottom walls 6, 7. At the center of the top wall 6 is provided a first engagement projection 8 that engages a rear shoulder portion 23 of the electric contact portion $C_1$ of the terminal C. On the bottom wall 7 is formed a flexible arm 9 extending forwardly and facing the first engagement projection 8. The top wall 6 has a window 10 cut therein extending from the front end thereof to near the projection 8.

The terminal locking block B is formed like a letter H lying on its side in cross section and made up of a preliminary locking plate 12 for the connector housing A, a flexible terminal locking plate 13, and a top plate 14. In more detail, the terminal locking block B has a horizontal base portion 15, on each side of which there is provided the flexible terminal locking plate 13 that extends horizontally into the corresponding paired terminal accommodating cavities 4. At the center of the base portion 15 is mounted the preliminary locking plate 12, which advances into the gap V between the opposing side walls 5 of the terminal accommodating cavities 4. At the base end portion of the preliminary locking plate 12 is mounted the top plate 14 that closes the window 10 of the terminal accommodating cavities 4 and which extends parallel with the flexible terminal locking plate 13.

The preliminary locking plate 12 has locking claws 12*a* at its free end that engage the side walls 5 of the terminal accommodating cavities 4. The flexible terminal locking plate 13 has second engagement projections 13*a* one on each side of the locking plate 12. The second engagement projections 13*a* are intended to engage with engagement holes 18 formed in the base portion 17 of the terminal C, as described later.

The terminal locking block B has stoppers 14*a* one on each side on the inner surface of the top plate 14 to prevent the forward overtravel of terminal C. At the center of its lower surface, the horizontal base portion 15 has a stopper 15*a* to prevent the terminal locking block B from becoming buried into the terminal accommodating cavities 4. The horizontal base portion 15 is preferably provided with a protective plate 16 (see FIG. 2) below the flexible terminal locking plate 13 so that the flexible terminal locking plate 13 will not be damaged by external force.

The terminal C, as shown in FIG. 2, consists of an electrical contact portion $C_1$ at the front of the base portion 17 and a wire connecting portion $C_2$ at the rear. These three members are formed integrally as one piece. The wire connecting portion $C_2$ is crimped with a wire 20 and is fitted with a water-proofing rubber grommet 21. The electrical contact portion $C_1$ is formed as a receptacle for receiving a mating male terminal not shown. The electrical contact portion $C_1$ has an engagement hole 18 in the base portion 17 and also stabilizers 19 one on each side of the engagement hole 18.

When the terminal C is not inserted, the connector housing A and the terminal locking block B are, as shown in FIG. 2, in a preliminary locked condition. In this condition, the locking claws 12*a* of the preliminary locking plate 12 engage the side walls of cavities 5 and the stopper 15*a* rests in a notch 11 cut at the end of the connector housing (see FIG. 1). Also in this condition the terminal C, which is connected with the wire 20 and fitted with the water-proofing rubber grommet 21, is inserted into the terminal accommodating cavity 4 from the rear open end thereof until it is engaged with the first engagement projection 8.

FIGS. 3A through 3D show the process from insertion of the terminal C to the full engagement of the terminal locking block B. FIG. 3E shows the terminal C in a half-inserted condition.

Figure 3A:
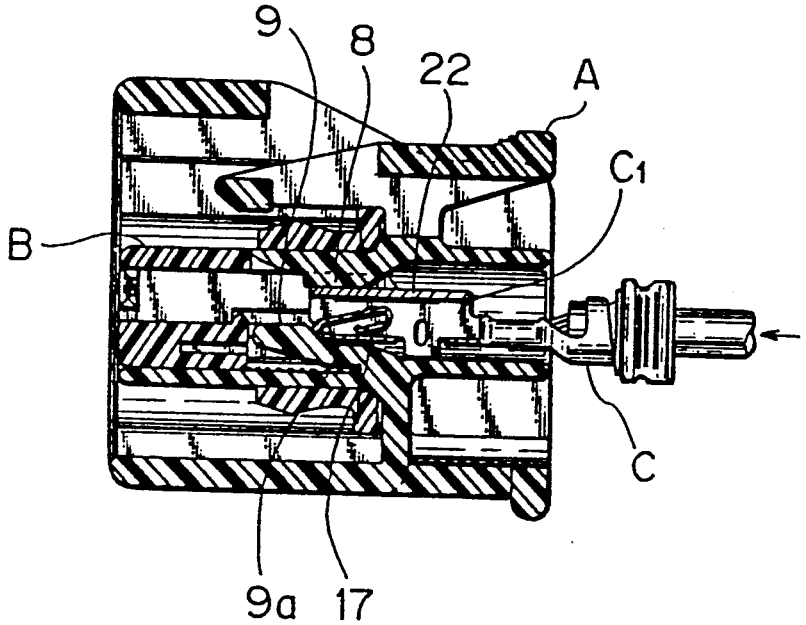

FIG. 3A illustrates the terminal C starting to be inserted, with the top wall 22 of electrical contact portion $C_1$ in contact with the inner surface of the first engagement projection 8 and with the front end portion of the base portion 17 in contact with a tapered drive surface 9*a* of the flexible arm 9.

Figure 3B:
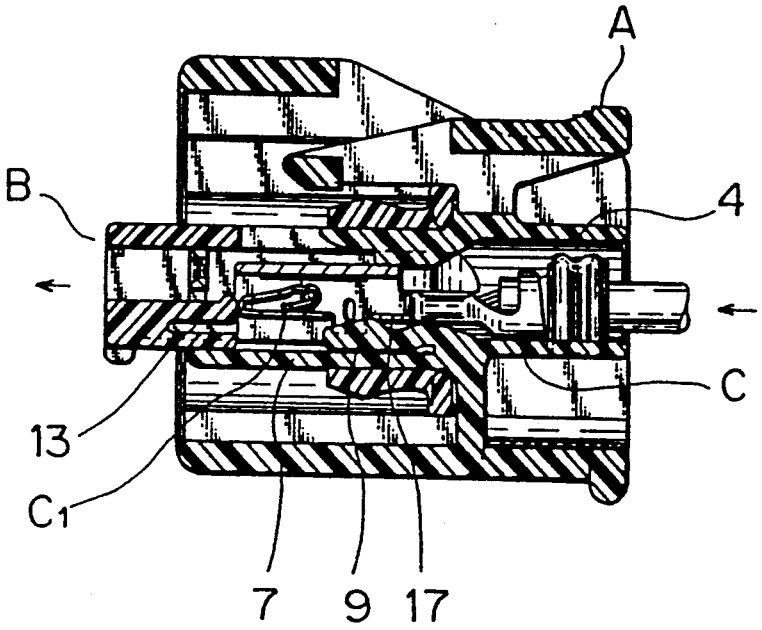

FIG. 3B illustrates the terminal C in the middle of the insertion process. As the terminal C is advanced into the cavity 4, the base portion 17 rides over the flexible arm 9 pressing it down toward the bottom wall 7. Then, the front end of the electrical contact portion $C_1$ abuts against the end surface of the flexible terminal locking plate 13, pushing the terminal locking block B slightly backward out of the terminal accommodating cavity 4 in the direction indicated by the arrow. In this condition, the terminal locking block B is released from the preliminary locked condition.

Figure 3C:
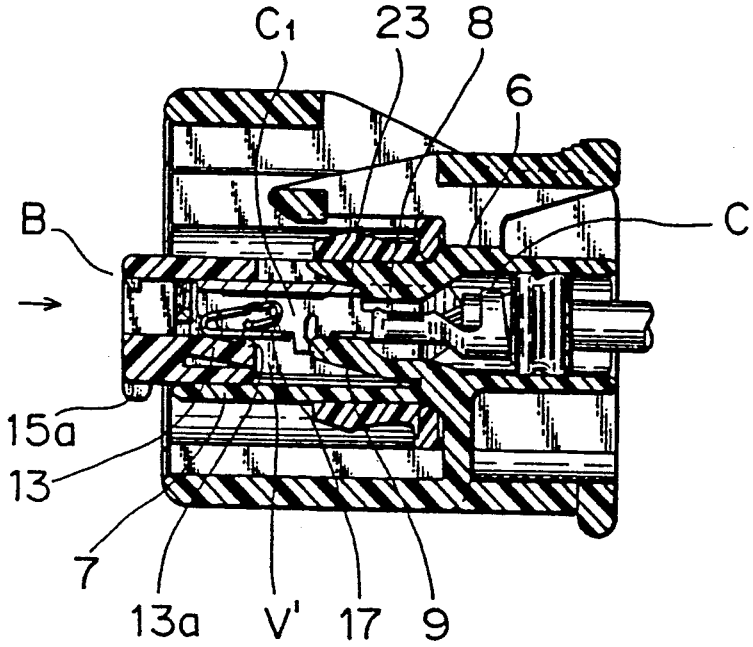

FIG. 3C shows the terminal C in a fully inserted condition. When the electrical contact portion $C_1$ moves past the first engagement projection 8, the terminal C is pressed against the top wall 6 by the elastic force of the flexible arm 9. At the same time, the engagement projection 8 engages the rear shoulder portion 23 of the electrical contact portion $C_1$, effecting the first locking of the terminal C. As a result, a space V' is formed between the base portion 17 of the terminal C and the bottom wall 7. The space V' is large enough to allow the flexible terminal locking plate 13 of the terminal locking block 8 to advance into the cavity under the base portion 17. The terminal locking block B is then partially pushed back into the space V' in the direction of the arrow of FIG. 3C, with the flexible terminal locking plates 13 being deflected toward the bottom wall 7 by the sliding contact between the second engagement projections 13*a* and the base portion 17.

Figure 3D:
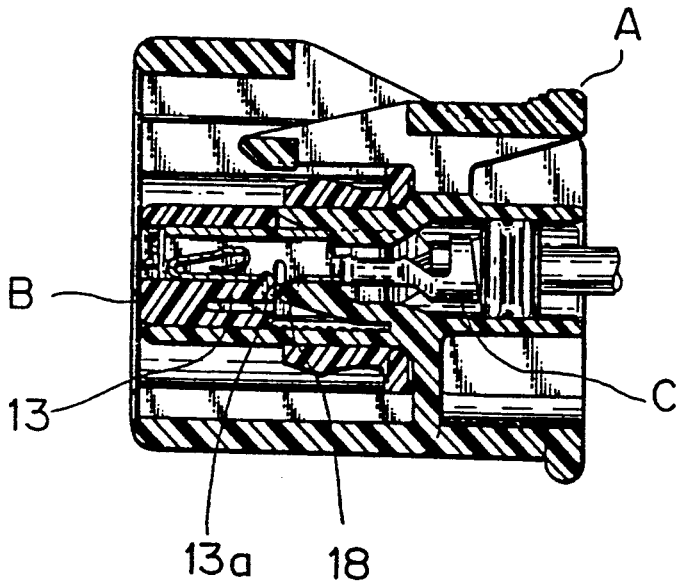
Figure 3E:
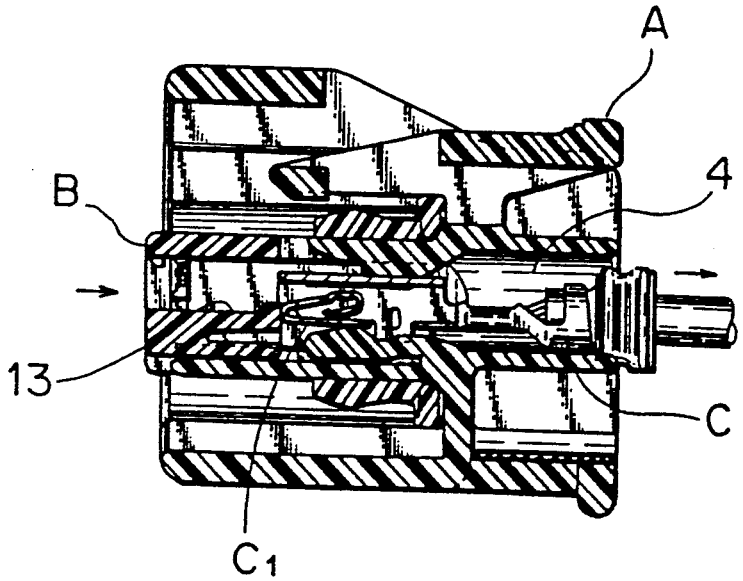
Figure 4:
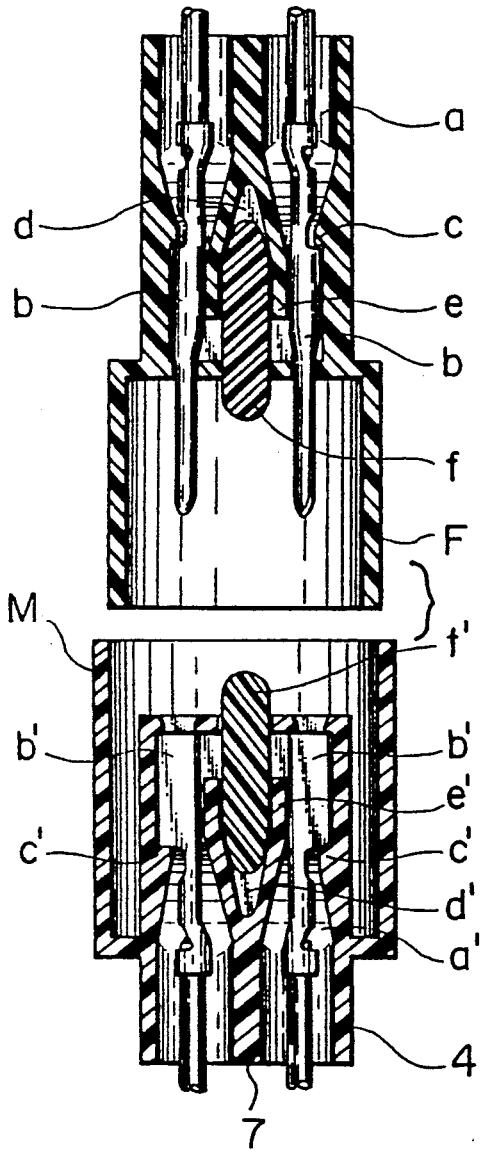
FIG. 4 PRIOR ART
FIGS. 4 and 5 are cross sections showing the conventional terminal locking structure.
Figure 5:
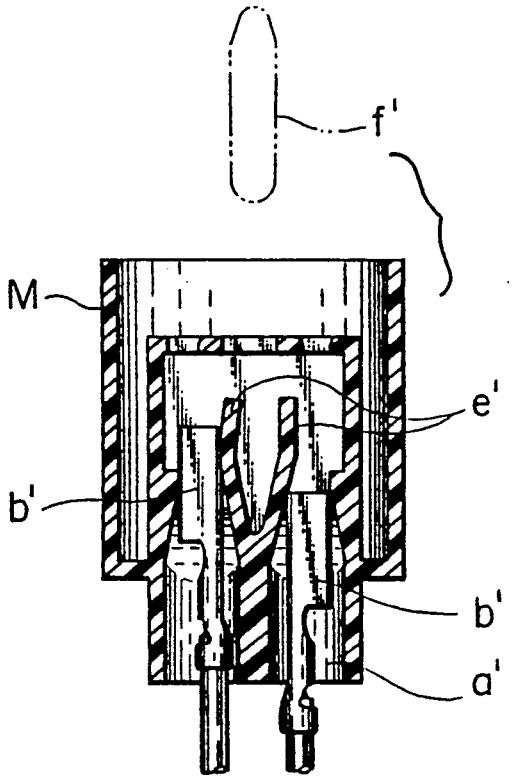
FIG. 5 PRIOR ART

FIG. 3D shows the terminal C in a fully locked condition. As the terminal locking block B is further inserted from the position shown in FIG. 3C, the second engagement projection 13*a* of the flexible terminal locking plate 13 reaches the engagement hole 18 of the terminal C. At this time, the second engagement projection 13*a* and the engagement hole 18 engage by the resilient force of the flexible terminal locking plate 13, thus effecting the second locking of the terminal C and also fully locking the terminal locking block B.

FIG. 3E illustrates the terminal C in an incompletely inserted condition. In this condition, if the terminal locking block 8 is pushed in the direction of arrow toward the full locked position, the flexible terminal locking plate 13 and the electrical contact portion $C_1$ abut against each other, pushing the terminal C out of the rear end of the terminal accommodating cavity 4. Therefore, the terminal locking block B cannot be fully locked, and this permits checking for any incomplete insertion of the terminal C.

As described above, the terminal locking block according to this invention has the following advantages. It can be attached beforehand, or preset, to the connector housing, helping to reduce the number of steps of assembly or control process. The locking of the terminal locking block can be achieved only when the terminals are completely inserted. Moreover, since the terminal locking block is, during the process of terminal assembly, protruded once from the front end of the connector housing, it is easily recognized, eliminating the possibility of an assembly worker forgetting to attach the terminal locking block.

What is claimed is:

1. An electrical connector having a terminal locking block, comprising:

terminals adapted to be inserted into a connector housing from the rear thereof, said terminals each having a base portion and an engagement hole in the base portion;

said connector housing having terminal accommodating cavities, each of said cavities having a first engagement projection formed on one of opposing wall surfaces of the cavity, the first engagement projection being adapted to engage said terminal fully inserted in a correct position; and a terminal locking block adapted to be inserted into and locked to a front part of said connector housing at a preliminary locked position and at a full locked position, said terminal locking block having a preliminary locking plate and a flexible terminal locking plate, these two plates extending rearwardly in the terminal accommodating cavities, said preliminary locking plate having locking means for engagement with said connector housing, said flexible terminal locking plate having second engagement projections to engage the engagement holes of said terminals, whereby when said terminals are not inserted into the terminal accommodating cavities said terminal locking block is attached to said connector housing by the locking means, and when said terminals are inserted into the cavities, front ends of said terminals abut an end of the flexible terminal locking plate to push said terminal locking block partly out of the terminal accommodating cavities, and when said terminals are fully inserted to the correct position a space is formed in the terminal accommodating cavities so as to allow the flexible terminal locking plate to be received rearwardly therein, and as said terminal locking block is pushed again into the terminal accommodating cavities the second engagement projections of the flexible terminal locking plate engage the engagement holes of said terminals, thus fully locking said terminal locking block into said connector housing.

2. The electrical connector as set forth in claim 1, wherein said preliminary locking plate is perpendicular to the flexible terminal locking plate.

* * * * *

UNITED STATES PATENT AND TRADEMARK OFFICE

CERTIFICATE OF CORRECTION

PATENT NO. : 5,088,938

DATED : February 18, 1992

INVENTOR(S) : Yoshihiro MURAKAMI et al

It is certified that error appears in the above-identified patent and that said Letters Patent is hereby corrected as shown below:

On the cover page, Item [75], second line, "Yammoto" should read -- Yamamoto --.

Signed and Sealed this

Eighteenth Day of May, 1993

*Attest:*

Michael K. Kirk

MICHAEL K. KIRK

*Attesting Officer*

*Acting Commissioner of Patents and Trademarks*